US006802423B2

(12) United States Patent
O'Brien

(10) Patent No.: US 6,802,423 B2
(45) Date of Patent: Oct. 12, 2004

(54) DISPOSABLE FOOD DELIVERY APPARATUS

(75) Inventor: John J. O'Brien, Winnemucca, NV (US)

(73) Assignee: Trans Global Foods, Inc., Winnemucca, NV (US)

( * ) Notice: Subject to any disclaimer, the term of this patent is extended or adjusted under 35 U.S.C. 154(b) by 99 days.

(21) Appl. No.: 10/080,283

(22) Filed: Feb. 20, 2002

(65) Prior Publication Data

US 2003/0154840 A1 Aug. 21, 2003

Related U.S. Application Data

(60) Provisional application No. 60/269,999, filed on Feb. 20, 2001.

(51) Int. Cl.[7] ..... A45C 11/20
(52) U.S. Cl. ..... 206/541; 206/216; 246/115
(58) Field of Search ..... 206/541, 216, 206/546, 542; 222/192, 212; 426/115

(56) References Cited

U.S. PATENT DOCUMENTS 3,116,152 A 12/1963 Smith
3,833,154 A 9/1974 Markowitz
3,834,570 A * 9/1974 Barr ..... 215/11.3
4,091,965 A 5/1978 Gebhard
4,803,088 A 2/1989 Yamamoto et al.
4,875,508 A * 10/1989 Burke et al. ..... 141/2
4,966,312 A 10/1990 Waring
5,137,183 A 8/1992 Mikulec et al.
5,305,928 A 4/1994 Verdaguer
5,332,121 A * 7/1994 Schmidt et al. ..... 222/95
5,361,918 A * 11/1994 Mason ..... 215/6
5,421,485 A * 6/1995 Furuta et al. ..... 222/95
5,682,931 A * 11/1997 Mouchmouchian ..... 141/319
5,705,212 A * 1/1998 Atkinson ..... 426/115
D397,933 S 9/1998 Mazda
5,881,926 A * 3/1999 Ross ..... 222/192
5,983,965 A * 11/1999 Patrick ..... 141/391
6,102,254 A 8/2000 Ross

* cited by examiner

*Primary Examiner*—Jila M. Mohandesi
(74) *Attorney, Agent, or Firm*—Clayton, Howarth & Cannon, P.C.

(57) ABSTRACT

Cubic boron nitride tooling, e.g. for woodworking, is fabricated with the same geometries and machinery as is used for fabricating conventional carbide tooling.

26 Claims, 12 Drawing Sheets

DISPOSABLE FOOD DELIVERY APPARATUS

CROSS-REFERENCE TO OTHER APPLICATION

This application claims priority from No. 60/269,999 filed Feb. 20, 2001, which is hereby incorporated by reference.

BACKGROUND AND SUMMARY OF THE INVENTION

The present invention relates to tools for cutting hard, non-metallic materials including abrasive wood and wood-based composites. More specifically, tools of interest include circular saws, milling cutters, routers, panel cutters and similar tools whose cutting edges can be fabricated from blanks of ultrahard polycrystalline cubic boron nitride (CBN) or the like.

Background: Woodworking Tools

Tooling for woodworking-type applications has some significant differences from the requirements of metalworking. (Many of the materials which are cut in woodworking-type applications are not merely wood, and sometimes not wood at all: particleboard and oriented-strand fiberboard, as well as non-wood polymers such as Melamine™ or other inorganic-loaded durable composites, may be encountered.) Common features of woodworking-type applications include air cooling (and associated high tooth speeds), workpiece materials with shear strengths much lower than ferrous metals, high shock loading (in many cases), and high abrasion. (Even among pure wood materials, many include microparticles of silicon dioxide, and composite materials may contain very abrasive filler components.)

Background: Carbide-Toothed Circular Saws

Cutting tools (especially woodworking tools) often use inserted teeth of a material which is harder than the hardest of steels. The most common material used for this is a "cemented carbide," which typically includes small grains of tungsten carbide bonded into a matrix with a metal (typically cobalt). (Because the strength and hardness of the matrix are derived from the grains of tungsten carbide, such cemented carbides are often referred to simply as "carbide.") Such "carbide" saw tips have a hardness of about 92 (Rockwell A).

Some firms manufacture only the steel bodies of circular saws, which are hardened, tempered and finished in every way except for tipping, and are then sold to other saw manufactures who specialize in carbide tipping. Other firms manufacture the complete saws including both the steel bodies and the installed tips. In either case, the same standard carbide tips are used in the fabrication of the blades. The steel bodies are normally made of high-carbon alloy tool steel, then a pocket is ground into the periphery of the saw body to accommodate the carbide tips. The tips may be ¼ to ⅜ inches long, 0.062 to 0.093 inches thick and from 0.10 to 0.375 inches wide, depending on the width of the finished saw blade.

In the woodworking industry, carbide tipped saws are typically 8 to 20 inches in diameter. Depending on their function, the 8 inch blades may have between 24 and 48 teeth, and the larger saws 60 to 100 teeth. For cutting non-ferrous metals, the number of teeth is typically between 24 and 80 for saws ranging from 8 to 18 inches in diameter. However, saws with greater tooth density (i.e. more teeth per inch) would be required to produce superior finishes and to cut thin materials.

Background: Ultrahard Cutting Tool Materials

Carbides were invented in the 1920s, and the search for better cutting materials continues to this day. In general, the ideal cutting tool surface should combine abrasion-resistance (hardness) with shock-resistance (toughness). (Of course there are many other relevant properties, including yield strength, rigidity, temperature limits, corrosion resistance in some applications, etc.) Materials which are harder than carbides are particularly interesting for woodworking applications, as well as many other applications.

In early 1970s, General Electric Company introduced a variety of Polycrystalline Diamond (PCD) cutting tool materials consisting of a layer of micron-sized diamonds integrally bonded with a carbide substrate. These man-made ultrahard crystalline and polycrystalline compounds have become readily available from commercial sources in a variety of grades, making possible tremendous advances in cutting tool design.

In practice, thin layers of PCD or CBN are bonded to a disk of tungsten carbide substrate ranging from 60 to 100 mm in diameter. The process requirements are extreme, e.g. 1300° C. and tens of thousands of atmospheres of pressure. These bonded disks, or wafers, generally have a combined thickness of around 3 to 4 mm with PCD or PCBN forming a single-sided layer 0.1 to 0.3 mm thick. The substrate face of tungsten carbide is ground flat and overall thickness is further reduced by grinding to one of several industry standard dimensions.

Then, using sophisticated computer controlled wire electrical discharge machine tools, the wafers are sliced into squares, rectangle, and round shapes dimensionally similar to standard carbide blanks and inserts. Ultimately, these "preforms" are ground into final dimensions for lathe tools or otherwise incorporated onto tool steel bodies in the same manner as carbide tips and inserts, and are sharpened by various special techniques.

The diamond layer's abrasion resistance, coupled with the carbide's strength, produced a cutting tool material that achieved a tremendous increase in machining performance over other available materials, tungsten carbide, for example. PCD is primarily used in non-ferrous metalworking applications such as copper and aluminum or to machine plastics, rubber, synthetics, and laminates. It had also found widespread use in sawing and shaping medium-density fiberboard and chipboard in the furniture industry. Unfortunately, notwithstanding is superb properties, it reacts chemically with iron and steel and cannot be used to machine any steel alloy.

Polycrystalline Cubic Boron Nitride (PCBN) is used for machining ferrous materials such as gray cast iron. PCBN is manufactured like PCD, except that a layer of cubic boron nitride crystals replace the diamond. Excellent machining results are obtained with PCBN-based tools in finish-turning work on nickel-based alloys. Because of its great hardness and wear resistance, PCBN cutting tools can be used at high cutting speeds and temperatures. In addition to higher available cutting speeds and excellent wear behavior, PCBN cutting materials achieve longer tool lives, allowing parts to be finished in a single cut, reliably attaining high accuracy over a long machining time.

Both PCD and PCBN provide major improvements over conventional carbide cermets, and it is now possible to machine substances that have previously been extremely difficult to fabricate. The most common ultrahard materials used in modern tools are polycrystalline diamond (PCD), which is 3.6 times harder than tungsten carbide, and cubic boron nitride (CBN), which is 2.8 times harder than carbide. However, the very properties of hardness and abrasion resistance that make polycrystalline tools superior cutting devices also make these tools extremely difficult to grind and finish.

Background: Cost Considerations for Ultrahard Materials

Despite their extraordinary performance, the application of these ultrahard materials is frequently limited by their high cost, which is at least ten times that of tungsten carbide. In addition, because of their extreme hardness, they can only be shaped with varying degrees of difficulty. PCD can only be ground by special diamond grinding wheels that are no harder than the PCD, and therefore, have a short service life. Other means of shaping PCD include electrodischarge machining (EDM) by either wire or shaped carbon electrode methods. Both of these methods require expensive, specialized computer controlled equipment that further adds to the cost of the tools in which they are incorporated.

The cost of polycrystalline diamond (PCD) and cubic boron nitride (CBN) are approximately the same. One might think, therefore, that absent diamond's inability to machine ferrous materials, there would be no practical use for PCBN which is less hard and less resistant to abrasion than PCB. Presumably because of the technical superiority of PCD over PCBN, no manufacturer recommends PCBN for wood, wood-composite products or plastics. Further, no toolmaker supplies tools for these applications.

Background: Grit-Surfaced (Non-Toothed) "Saws"

A common type of cutting tool is a circular blade which does not have shaped teeth at its edge, but which is simply coated with a diamond grit. Such cutting tools are commonly referred to as diamond "saws," but in fact they do not perform the same type of material-removal action as is performed by a saw with shaped teeth. A saw with shaped teeth, when it is operating correctly, will carve off chips of material. By contrast, a grit-coated blade will have more of a scraping or abrasive action. (See generally Jim Effner, Chisels on a wheel (1992); and Peter Koch, Utilization of Hardwoods Growing on Southern Pine Sites (1985); both of which are hereby incorporated by reference.) A cutting action is greatly preferable for many applications, to produce a cleaner cut, lower temperature, and lower power requirements.

Polycrystalline Cubic Boron Nitride (PCBN) Woodworking Tools and Methods

The present inventors have discovered that PCBN cutting tips can be accurately ground with the same equipment commonly used to fabricate high quality tungsten carbide tools, with substantially the same geometries, and with only slight modifications of technique. Thus it turns out that, for woodworking applications, PCBN tooling is much more nearly analogous to carbide than to diamond. This is quite contrary to common belief in the industry, and radically changes the economics of PCBN tooling.

There are severe restrictions on tooth geometry of PCD tools, particularly the hook angle: the use of positive hook angles (as is usual with circular saws for woodworking) can cause PCD tools to chatter or to suffer fracture. (Hook angle is the angle of the leading face of the tooth: if the tooth is angled to pull workpiece material back toward the center of the blade, it is said to have a positive hook angle.) Thus use of very small or negative hook angles is necessary with PCD tools. The geometry of PCBN cutters however, can be made to very closely approximate those of proven carbide tools, i.e. positive hook angles can be used for faster and cooler cutting.

A profound advantage of PCBN over PCD in all but the largest operations, is that PCBN tools can be maintained using modified $20,000 grinding machines where PCD requires an electrodischarge machine costing ten times as much. This makes on-site or near site service feasible, reduces tool repair costs, turnaround time, and the inventory cost of spares.

BRIEF DESCRIPTION OF THE DRAWING

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

Figure 1:
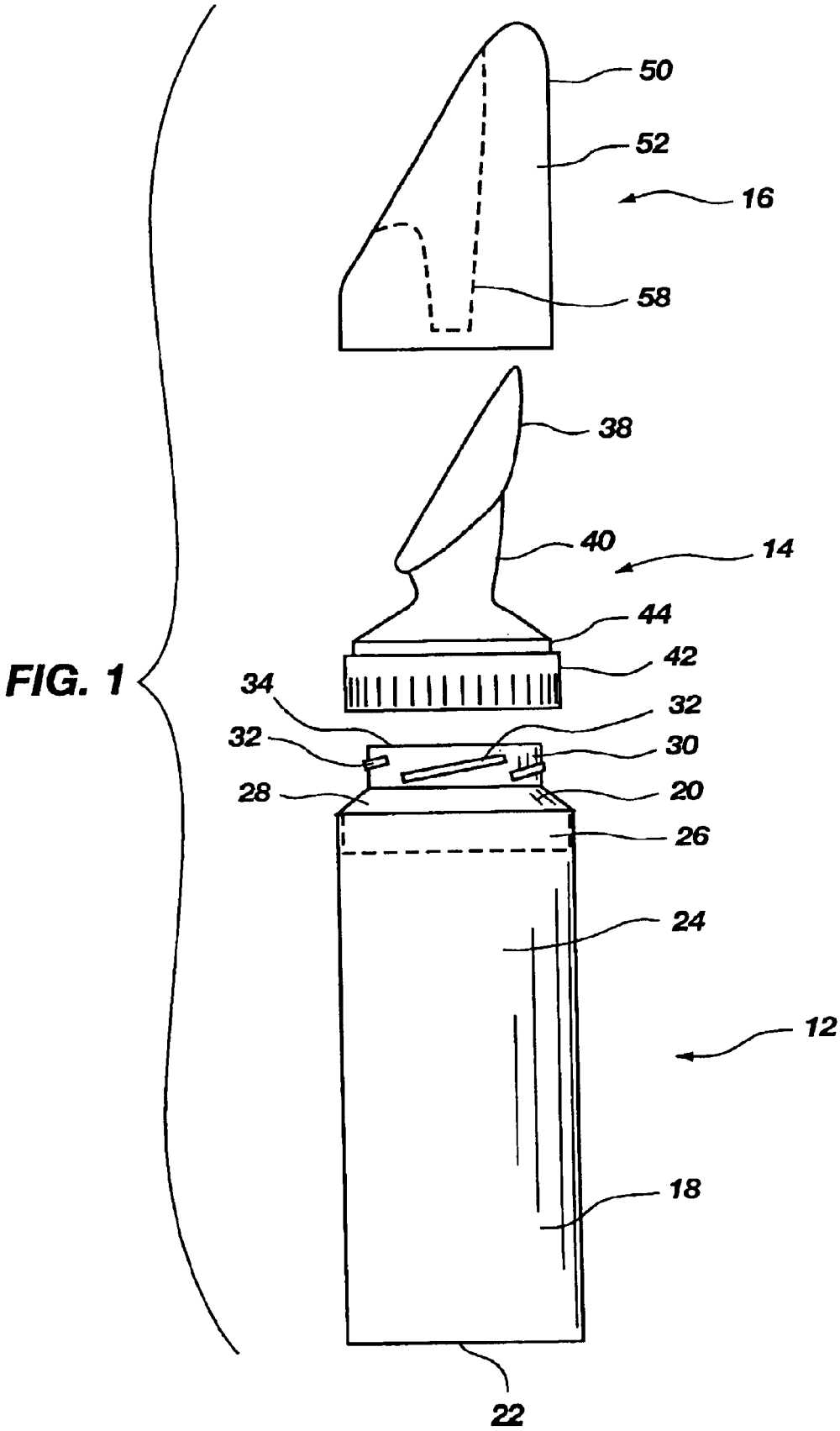
FIG. 1 shows a circular saw blade using the novel cutting tips of the present application.

The numerous innovative teachings of the present application will be described with particular reference to the presently preferred embodiment (by way of example, and not of limitation).

At first appearance, it would appear that PCBN could not compete with PCD in the areas amenable to PCD applications. PCD is harder than PCBN and tests on certain materials show that it is less resistant wear. However, studies and experiments by the present inventors have indicated that wear due to abrasion is most important, and that wear tests of PCBN conducted on hardened steel at 600° C. are not necessarily applicable to cutting wood products where sharpness and edge retention are paramount. At this juncture we have not proved that wear characteristics of PCBN woodworking tools are inferior to PCD at all (although this is suspected from physical properties).

It turns out that most carbide tools compete with other carbide tools and not with PCD. If PCBN tools can be produced at five times the cost of carbide tools (a realistic expectation, especially if using the novel tooth configuration of Ser. No. 09/469,673, which is hereby incorporated by reference) and PCBN outlasts carbide by 20 fold, it is quite feasible to economically use PCBN tools in wood-product applications.

It has been discovered, through experimentation and field test that rotating tools (e.g. saws, shapers, and routers) tipped with Polycrystalline Cubic Boron Nitride (PCBN) cutting elements, perform extremely well in the shaping of medium-density fiberboard and chipboard material. These tools were made in the laboratory of Sheffield Saw and Tool using readily available preforms from two of the major suppliers of PCBN.

In a sample embodiment, the cutting tips are commercial carbide-backed BZN boron nitride (from GE), supplied in widths about 0.040" over that required. The cutting tip blanks were brazed into place using a standard low-melting-point high-Ag silver solder (Handy and Harmon Eazy-Flow-3, in a sample embodiment).

Top grinding was done with a Vollmer CHC 020 machine, and side grinding was done with a Vollmer FS2A dual side-grinder. (These are machines which are normally used for grinding carbide teeth, and are NOT suitable for grinding diamond teeth.) Triple-chip tooth geometry was used in a sample embodiment, but other geometries can be used, including alternate top bevel (ATB), conical ATB, ATB/chamfer, flat, conical-flat, and trapezoidal, for example.

Both single- and dual-grit diamond wheels have been used successfully.

In a sample embodiment, diamond grit sizes from 200 to 800 grit have been used, i.e. closely comparable to those which would be used for sharpening a carbide-toothed blade.

However, a notable difference is that the feed rate must be less for grinding boron nitride-tipped cutters than for conventional carbide-tipped ones. In a sample embodiment, the feed rate was reduced to 50% of that which would be used for grinding conventional saw tooth carbides.

The hook angles of the PCBN teeth were typically set at about 5 degrees less than would be used for a positive-hook carbide tooth application. Thus for a rough ripping application, where a carbide tooth might be set at 20° or more, a PCBN tooth would be given a hook angle of e.g. 15°. (However, PCBN teeth are believed to be less economical for such applications, due to the high density of foreign objects encountered.) The key point is the PCBN teeth can be given a hook angle which is less positive than that of carbide teeth, but significantly more positive than would be possible with diamond teeth.

Performance comparison against carbide shows that the PCBN tools outperform carbide by at least a factor of 50. An accurate performance index is difficult to compute, because the lifetimes of the PCBN tools are so extremely long.

A test was also run to compare an experimental PCBN saw with a conventional PCD saw. The operator who was using a PCD saw on a trial basis complained that the force required to push the saw through the material was excessive compared to a carbide blade. No problem was experienced with a PCBN blade, probably because the hook angle was comparable to that on a carbide blade.

FIG. 1 shows a circular saw blade 110 using the novel cutting tips of the present application. As described above, the body 102 will typically be a steel plate, typically with appropriate tensioning for flatness under load. Radius R, reproduced in the following figures, will be used to show how the tooth geometry relates to the central hole 104.

FIG. 2C shows a section of the circular saw blade of FIG. 1, with cubic-boron-nitride-containing teeth 103A/103B set with a positive hook angle. Note that the blade's radii do NOT lie in the face plane of each tooth. Preferable these teeth, as described above, include a PCBN layer 103B on a tungsten carbide layer 103A. The positive hook angle shown in this Figure has been slightly exaggerated for clarity, but is preferably more positive than would be used with diamond-coated teeth. Hook angles differ with different application, but, for any given application, the hook angle preferably used with the teeth of the presently preferred embodiment is more positive than that which would be used with diamond, and preferably is closer to the angle which would be used (for that application) with a carbide tooth rather than a diamond tooth.

FIG. 2A shows a section of a conventional circular saw blade, with diamond-tipped teeth set with a negative hook angle. In this example two instances of the radius R are shown, to show how the tooth face plane relates to the blade radius: note how each tooth is leaning slightly backwards (opposite to the geometry of FIG. 2C).

For clarity, FIG. 2B shows a section of a conventional circular saw blade 110" in which the teeth are set with a zero negative hook angle.

Figure 2:
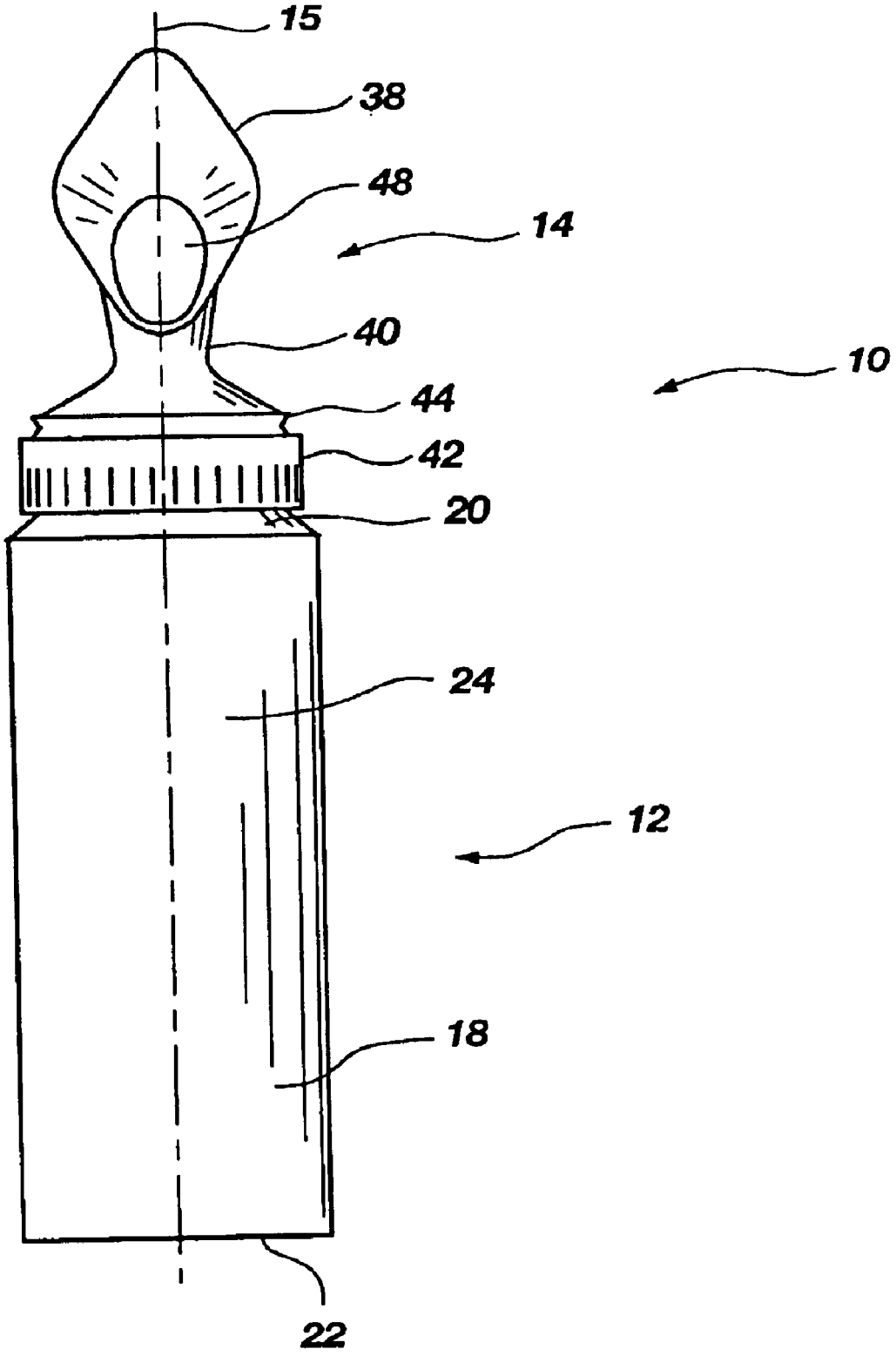
FIG. 2A shows a section of a conventional circular saw blade like that of FIG. 1, with diamond-tipped teeth set with a negative hook angle.
FIG. 2B shows a section of a circular saw blade like that of FIG. 1, with teeth having a zero negative hook angle.
FIG. 2C shows a section of the circular saw blade of FIG. 1, with cubic-boron-nitride-containing teeth set with a positive hook angle.
Figure 3:
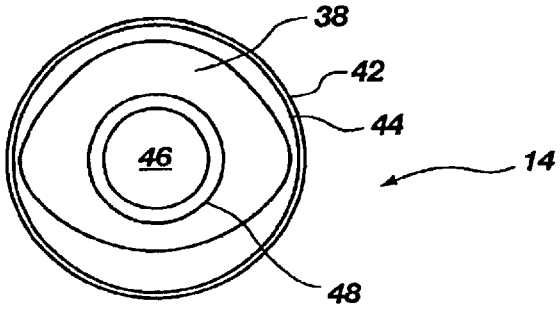
FIG. 3 shows an example of another cutting tool which can use teeth like those of FIG. 2C, and also shows how hook angle is measured in such tools.

FIG. 3 shows an example of another cutting tool which can use teeth like those of FIG. 2C, and also shows how hook angle is measured in such tools. The solid line is normal (perpendicular) to the cutting tooth circle (which in this example has infinite radius, i.e. is a straight line), and the dotted line shows the face plane of a tooth. In this example the teeth are set with a slight "scooping" angle, i.e. have positive rake.

Definitions:

Following are short definitions of the usual meanings of some of the technical terms which are used in the present application. (However, those of ordinary skill will recognize whether the context requires a different meaning.) Additional definitions can be found in the standard technical dictionaries and journals.

Braze: to solder with brass or other hard alloy.

Carrier Blade: a blade, typically made of steel, to which a cutting tip is attached.

Carbide: a material more commonly referred to as cemented carbide which typically includes small grains of tungsten carbide bonded into a matrix at high temperatures and pressure by another metal which is typically cobalt. The name cemented carbide comes from the fact the both the strength and hardness of the substance are derived from the compound of tungsten and carbon (WC), and another material (frequently cobalt) serves merely as a binder.

Chatter: as used herein is vibration or movement of the cutting tool engaged in the cut due to exterior forces applied against an inadequately supported cutting tip.

Cutting Tip: a material that is usually harder than steel that is attached to the tips of a carrier blade to provide a harder cutting surface. (See FIGS. 1, 2, and 3 for an illustration).

Solder: to make a tight junction of metallic sheets, piping, and the like, by the application of a molten alloy.

Tungsten Carbide: (WC), a cemented carbide which is harder than steel.

Pocket: an indention in a carrier blade shaped to receive a cutting tip. (See FIGS. 1, 2, and 3 for an illustration).

Superhard Material: any material harder than steel.

Ultrahard Materials: any material harder than tungsten carbide, including but not limited to polycrystalline diamond (PCD) and cubic boron nitride (CBN).

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

For example, the described methods and geometries are not solely applicable to woodworking-type applications, but can also be applied advantageously to other applications where abrasion resistance is a high concern (such as precision machining of uncured or partially-cured ceramic structures).

It should also be noted that the disclosed inventions are applicable to manual-feed as well as to automatic grinding machines.

Note also that, although woodworking applications are preferred, boron nitride teeth can also cut ferrous materials (unlike diamond teeth).

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

What is claimed is:

1. A disposable food delivery apparatus comprising:

(a) a food container comprising a flexible bag;

(b) a food utensil couplable to the food container, the food utensil comprising a first opening;

(c) a funnel member disposed on the food utensil, the funnel member comprising a channel for transferring food from the food container to the food utensil through the first opening in the food utensil; and (d) a cap couplable to the food utensil for covering the food utensil, the cap comprising a side wall and a top disposed on the side wall, the top having a plug extending therefrom and configured for extending through the first opening in the food utensil and being received in the channel for closing the channel and preventing food from passing therethrough.

2. The disposable food delivery apparatus of claim 1 wherein the food container further comprises a collar on which the flexible bag is disposed such that there is no leakage of liquid or semi-liquid food between the flexible bag and the collar.

3. The disposable food delivery apparatus of claim 2 wherein the flexible bag is attached to the collar by a heat seal.

4. The disposable food delivery apparatus of claim 2 wherein the flexible bag is attached to the collar by an adhesive.

5. The disposable food apparatus of claim 2 wherein the collar comprises a neck portion that is releasably attachable to the food utensil.

6. The disposable food apparatus of claim 5 wherein the neck portion comprises a plurality of first ridges configured for releasably attaching the food container to the food utensil.

7. The disposable food delivery apparatus of claim 6 wherein the food utensil comprises an inner wall on which are disposed a plurality of second ridges configured for releasably engaging the plurality of first ridges disposed on the collar for forming a leak-proof seal for attaching the food utensil to the food container.

8. The disposable food delivery apparatus of claim 2 wherein the collar comprises a second opening through which food in the food container can pass from the food container to the food utensil.

9. The disposable food delivery apparatus of claim 8 wherein the collar further comprises a removable seal for sealing the opening.

10. The disposable food apparatus of claim 8 further comprising a dehydrated food disposed in the food container.

11. The disposable food delivery apparatus of claim 1 wherein the flexible bag comprises a plastic material.

12. The disposable food delivery apparatus of claim 11 wherein the flexible bag comprises polyethylene.

13. The disposable food delivery apparatus of claim 11 wherein the flexible bag comprises polypropylene.

14. The disposable food delivery apparatus of claim 11 wherein the flexible bag comprises a polymer.

15. The disposable food delivery apparatus of claim 1 wherein the flexible bag forms a vessel for holding food.

16. The disposable food apparatus of claim 1 wherein the food utensil comprises a bowl disposed on the funnel members and the funnel member is disposed on a ring member.

17. The disposable food delivery apparatus of claim 16 wherein the funnel member comprises a rim configured for cooperatively engaging the cap for holding the cap over the bowl and funnel member.

18. The disposable food apparatus of claim 17 wherein the side wall comprises a an inner surface having a lower end thereof, wherein the lower end of the inner surface is configured for cooperatively engaging the rim of the food utensil for holding the cap to the food utensil by friction.

19. The disposable food delivery apparatus of claim 16 wherein the first opening is disposed on the bowl and the channel ends at the first opening in the bowl.

20. The disposable food apparatus of claim 1 further comprising a dehydrated food disposed in the food container.

21. The disposable food apparatus of claim 20 further comprising a removable seal for sealing the opening.

22. The disposable food delivery apparatus of claim 1 wherein the food utensil comprises a tubular straw-like member disposed on a funnel member, and the funnel member is disposed on a ring member.

23. The disposable food delivery apparatus of claim 22 wherein the funnel member comprises a rim configured for cooperatively engaging the cap for holding the cap over the tubular straw-like member and funnel member.

24. The disposable food delivery apparatus of claim 22 wherein the funnel member comprises the channel for receiving food from the food container and channeling the food to the tubular straw-like member.

25. A disposable food delivery apparatus comprising:

(a) a food container comprising a flexible bag having an interior;

(b) a base removably attachable to the food container;

(c) a food utensil coupled to the base, the food utensil comprising a bowl, an opening disposed on the bowl, and a neck, the neck comprising a hollow passage interconnecting the interior of the food container and the opening;

(d) a fill port disposed on the base leading to the interior of the flexible bag;

(e) a fill door having a first position and a second position, the fill door sealing the fill port when in the first position; and (c) a cap couplable to the base for covering the food utensil.

26. A disposable food delivery apparatus comprising:

(a) a food container comprising a flexible bag, the food container further comprising a collar on which the flexible bag is disposed such that there is no leakage of liquid or semi-liquid food between the flexible bag and the collar, wherein the collar comprises an opening through which food in the food container can pass from the food container to a food utensil;

(b) a removable seal for sealing the opening in the collar;

(c) the food utensil couplable to the food container, the food utensil comprising a bowl disposed on a funnel member, and the funnel member being disposed on a ring member, the bowl comprising an opening;

(d) a channel for receiving food from the food container and channeling the food to the bowl through the opening in the bowl;

(e) a cap couplable to the food utensil for covering the food utensil, the cap comprises a housing that defines a chamber, wherein the cap comprises a side wall and a top disposed on the side wall, the top having a plug extending therefrom and configured for extending through the opening in the bowl and being received in the channel of the food utensil for closing the channel and preventing food from passing therethrough.

* * * * *

UNITED STATES PATENT AND TRADEMARK OFFICE

CERTIFICATE OF CORRECTION

PATENT NO. : 6,802,423 B2
DATED : October 12, 2004
INVENTOR(S) : John J. O'Brien It is certified that error appears in the above-identified patent and that said Letters Patent is hereby corrected as shown below:

Title page,
Item [60], Related U.S. Application Data, "Provisional application No. 60/269,999, filed on Feb. 20, 2001." should be deleted.
Item [57], ABSTRACT, "Cubic boron nitride tooling, e.g., for woodworking, is fabricated with the same geometries and machinery as is used for fabricating conventional carbide tooling." should read -- A disposable food delivery device is disclosed. The device includes a food utensil coupled to a food container. The food container can be pre-charged with food, such as a dehydrated food, such that a liquid can be added to the dehydrated food to result in a ready-to-eat food at any selected time. The food container illustratively can include a port for receiving the liquid. The food container also illustratively can include a security seal for assuring that the food has not been contaminated prior to consumption. Another illustrative embodiment of the invention includes a valve for retaining liquid in the food container prior to consumption of the food. --.

Column 1, line 2, through Column 6, line 67,
Should read:

-- CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to a disposable food delivery apparatus. More particularly, this invention relates to a disposable food delivery apparatus comprising a food container coupled to a food utensil member. In an illustrative embodiment of the invention, the food container is pre-charged with food, such as a dehydrated food that can be rehydrated with water in the food container such that dehydrated food is rendered ready to eat. In such an illustrative embodiment, the food container illustratively comprises a port for receiving the water therein. In another illustrative embodiment of the invention, the food container comprises a security seal for assuring that the food has not been contaminated prior to consumption. In still another illustrative embodiment of the invention, the food container comprises a valve for retaining liquids in the food container until the food is ready for consumption.

It is certified that error appears in the above-identified patent and that said Letters Patent is hereby corrected as shown below:

Column 1, line 2, through Column 6, line 67 (cont'd),

In recent years, foods that are ready to eat or that can be prepared quickly and with a minimum of effort have become a growing part of the American diet. So-called "fast foods" are increasingly popular, but often are high in calories, high in fat, and low in nutritional quality. It will be appreciated that providing a food delivery device that provides for quick and easy preparation of healthy, nutritious food would be a significant advancement in the art.

BRIEF SUMMARY OF THE INVENTION

A disposable food delivery device is disclosed. The device includes a food utensil disposed on a food container. The food container can be pre-charged with food, such as a dehydrated food, such that a liquid can be added to the dehydrated food to result in a ready-to-eat food at any selected time. The device includes a channel for conducting the food from the food container into the food utensil, where it is available for consumption. The food container or food utensil can illustratively can include a port for receiving the liquid to be added to the dehydrated food. The food container also illustratively can include a security seal for assuring that the food has not been contaminated prior to consumption. Another illustrative embodiment of the invention includes a valve for retaining liquid in the food container prior to consumption of the food.

BRIEF DESCRIPTION OF THE SEVERAL VIEWS OF THE DRAWINGS

FIG. 1 shows an exploded side elevation view of an illustrative food delivery apparatus according to the present invention.

FIG. 2 shows a front elevation view of the food delivery apparatus of FIG. 1 without the cap.

FIG. 3 shows a top view of the food utensil portion of the food delivery apparatus of FIG. 1.

Figure 4:
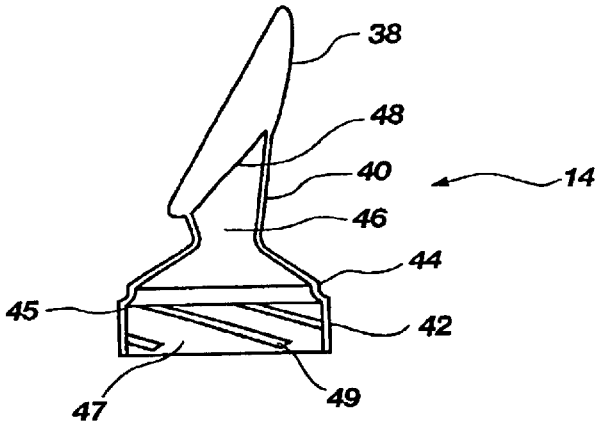

FIG. 4 shows a sectional view along line 15 of the food utensil portion of the food delivery apparatus of FIG. 1

Figure 5:
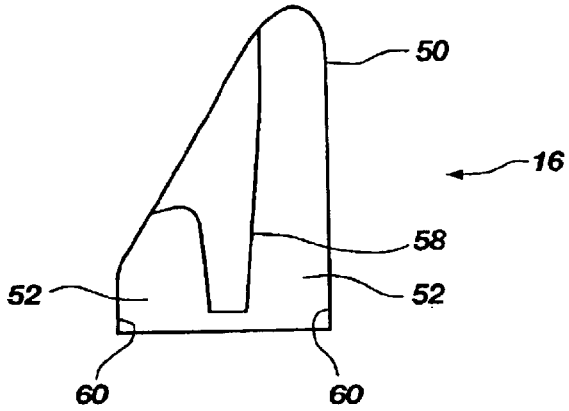

FIG. 5 shows side sectional view of the cap of the food delivery apparatus of FIG. 1.

Figure 6:
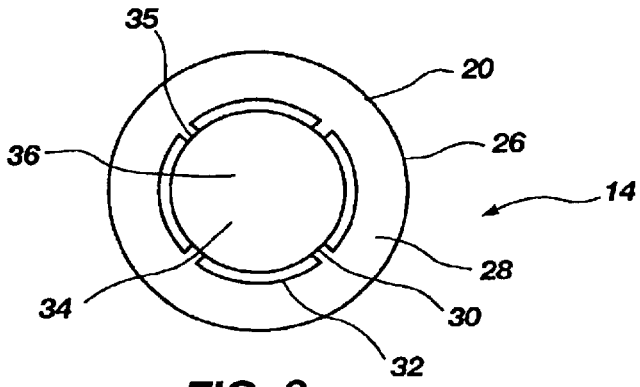

FIG. 6 shows a top view of the food container portion of the food delivery apparatus of FIG. 1.

Figure 7:
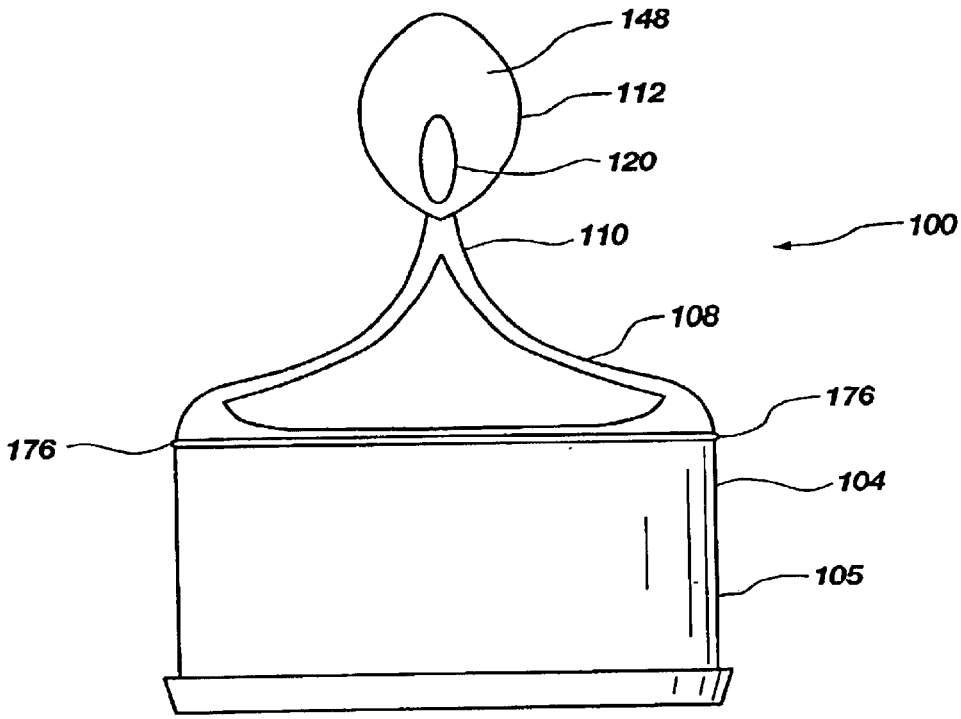

FIG. 7 shows a front elevation view of an illustrative food delivery apparatus according to the present invention.

Figure 8:
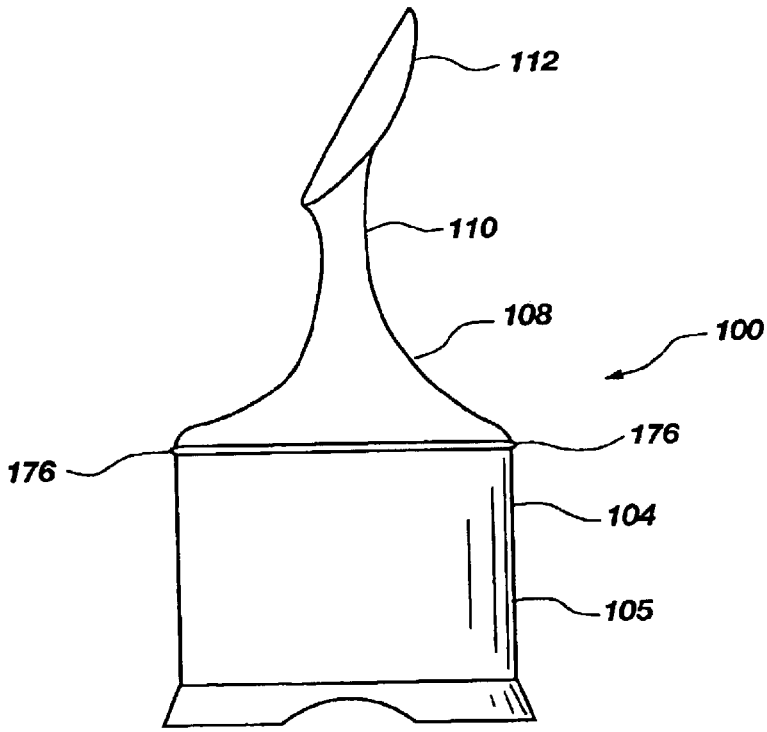

FIG. 8 shows a side elevation view of the food delivery apparatus of FIG. 7.

Figure 9:
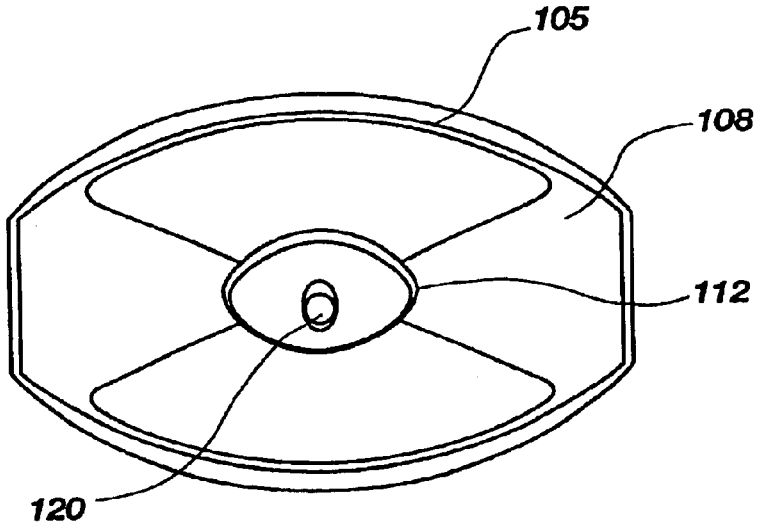

FIG. 9 shows a top view of the food delivery apparatus of FIG. 7.

Figure 10:
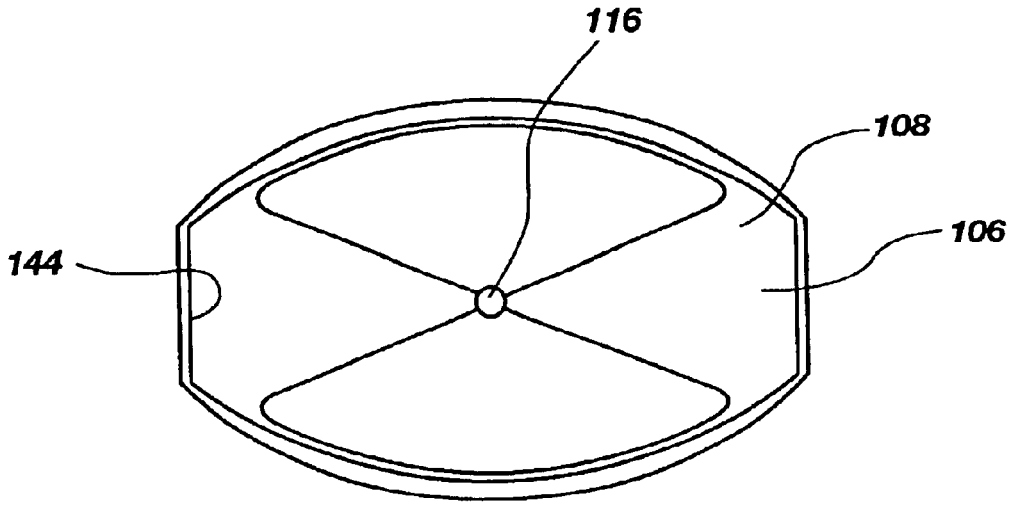

FIG. 10 shows a bottom view of the food delivery apparatus of FIG. 7.

Figure 11:
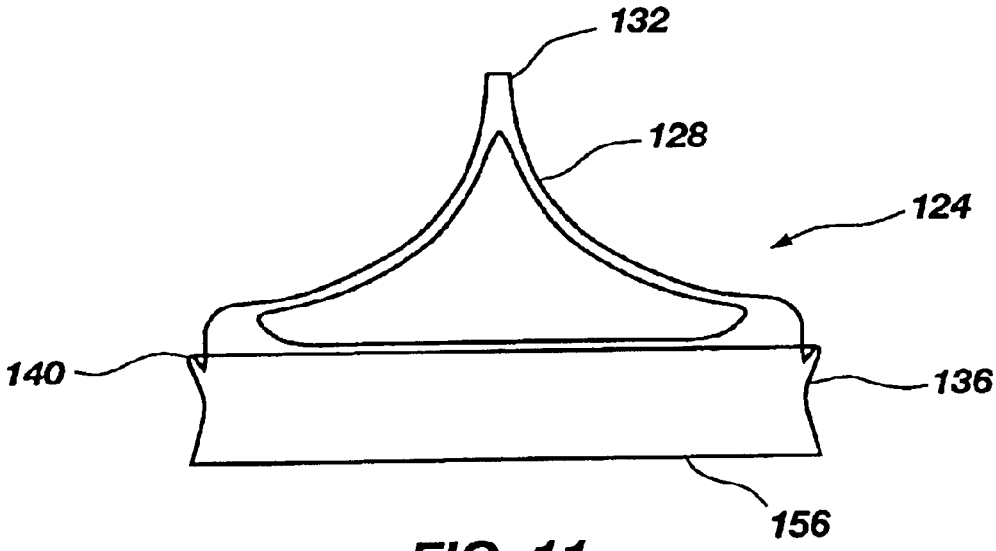

FIG. 11 shows a side elevation view of a plunger for use with the food delivery apparatus of FIG. 7.

Figure 12:
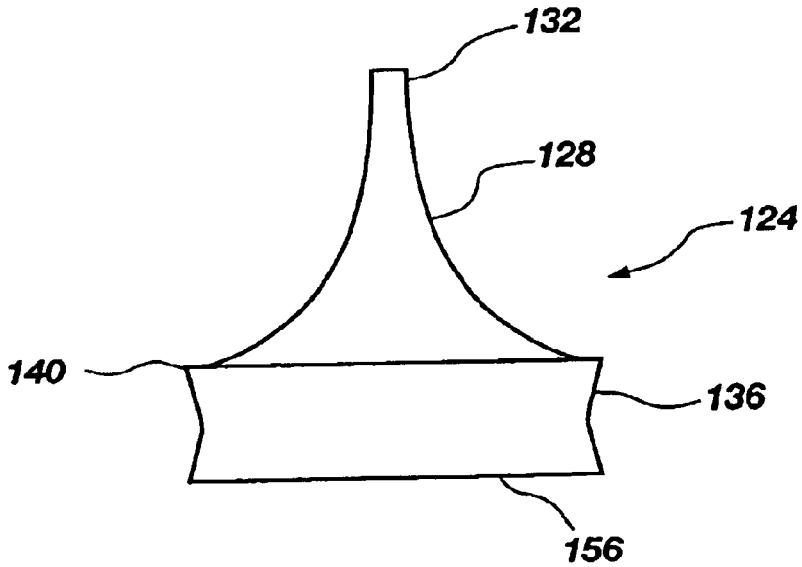

FIG. 12 shows a side view of the plunger of FIG. 11.

Figure 13:
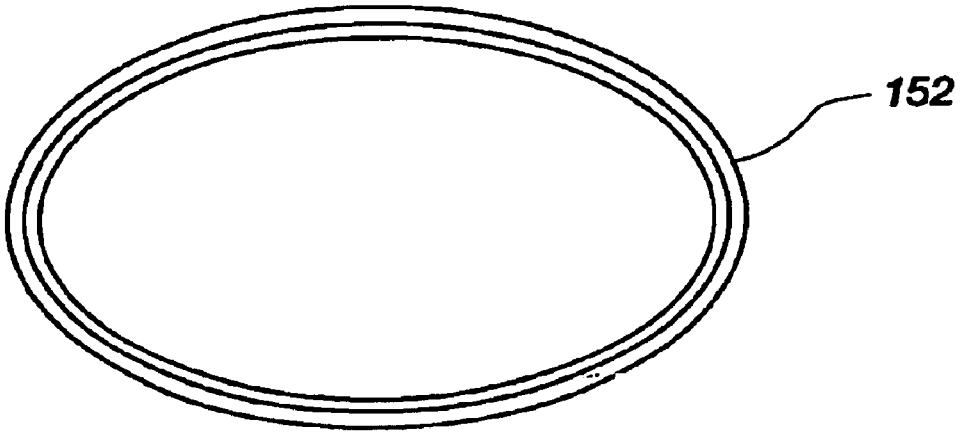

FIG. 13 shows a top view of a pressure plate for use with the food delivery apparatus It is certified that error appears in the above-identified patent and that said Letters Patent is hereby corrected as shown below:

Column 1, line 2, through Column 6, line 67 (cont'd),
of FIG. 1.

Figure 14:
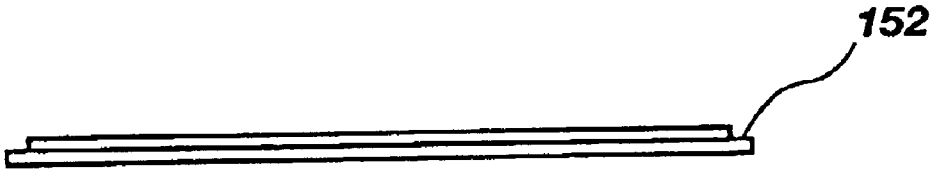

FIG. 14 shows a side view of the pressure plate of FIG. 13.

Figure 15:
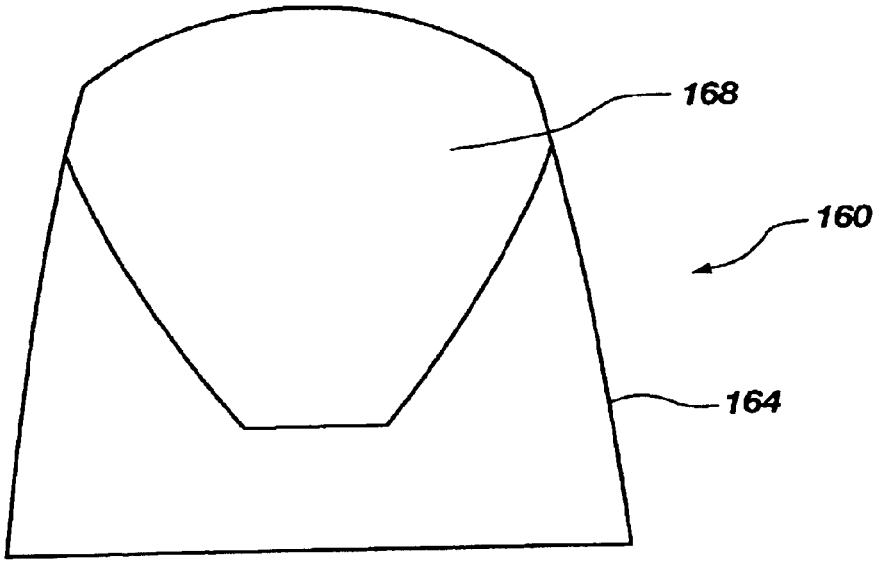

FIG. 15 shows a front elevation view of a cap for use with the food delivery apparatus of FIG. 7.

Figure 16:
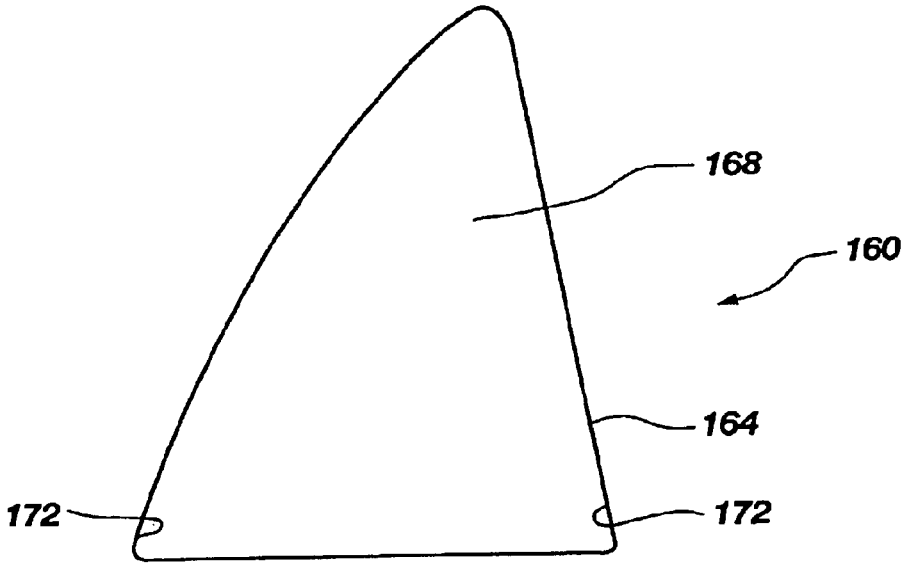

FIG. 16 shows a side elevation view of the cap of FIG. 15.

Figure 17:
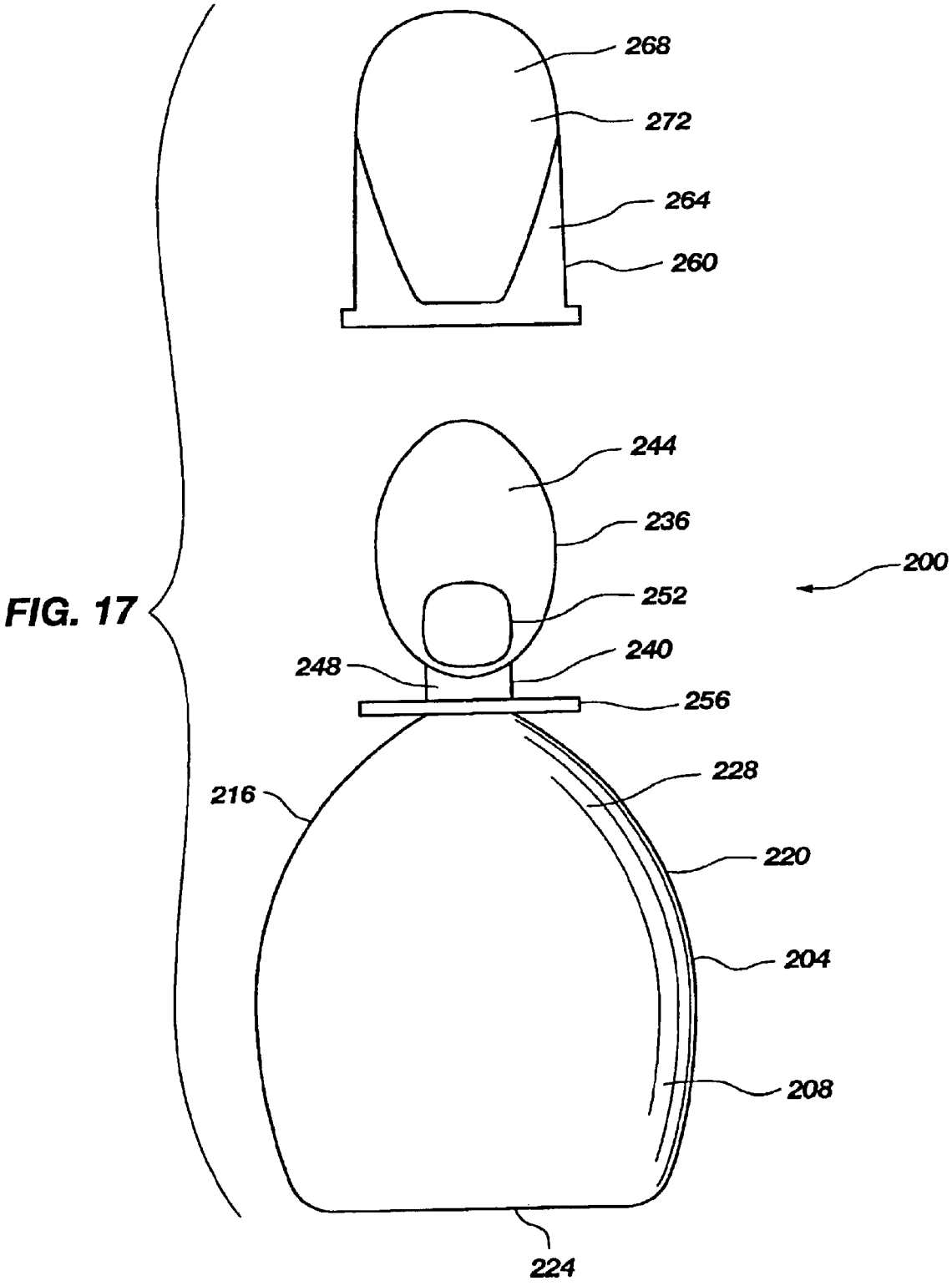

FIG. 17 shows an exploded front elevation view of an illustrative food delivery apparatus according to the present invention.

Figure 18:
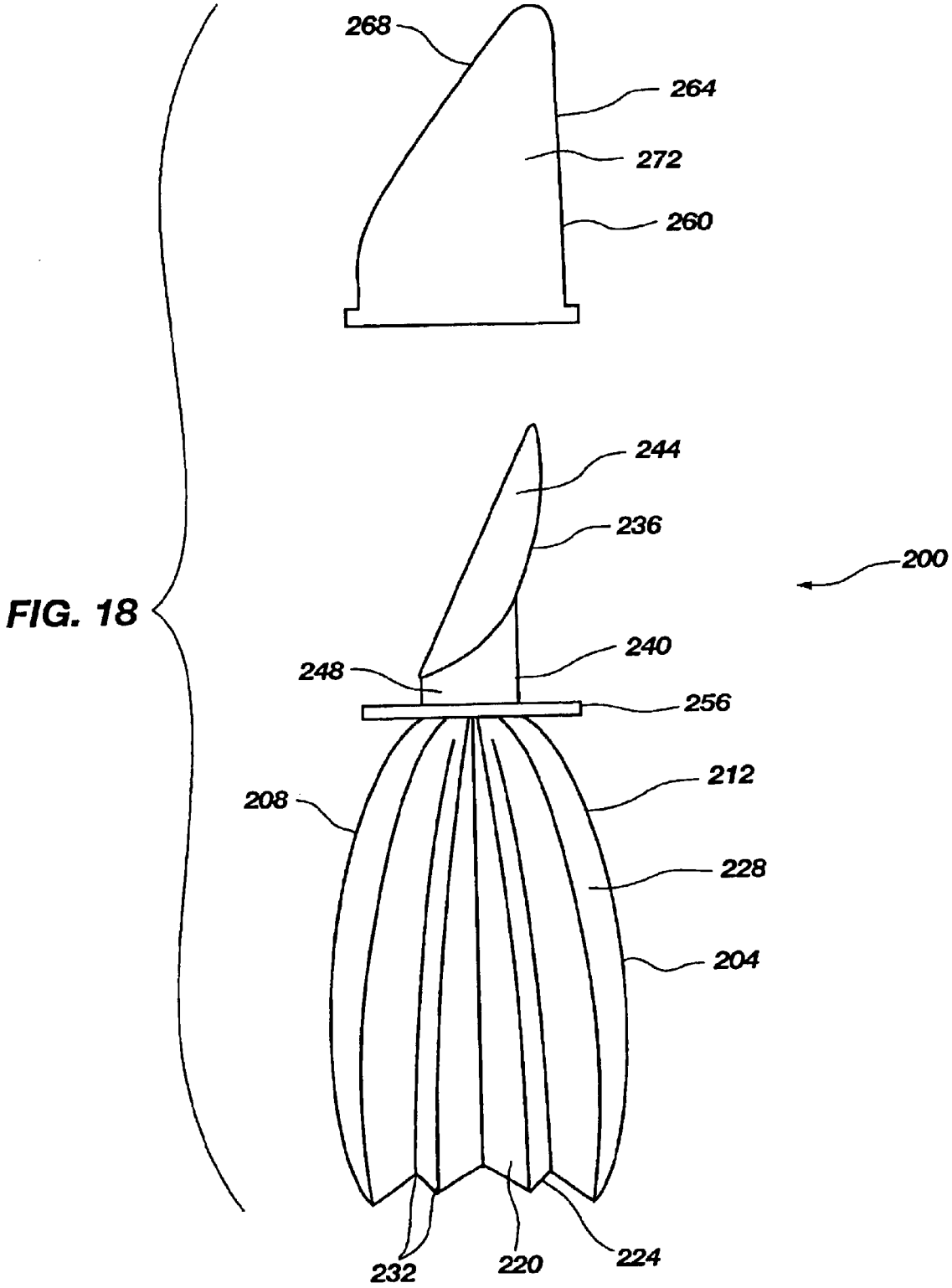

FIG.18 shows an exploded side elevation view of the food delivery apparatus of FIG. 17.

Figure 19:
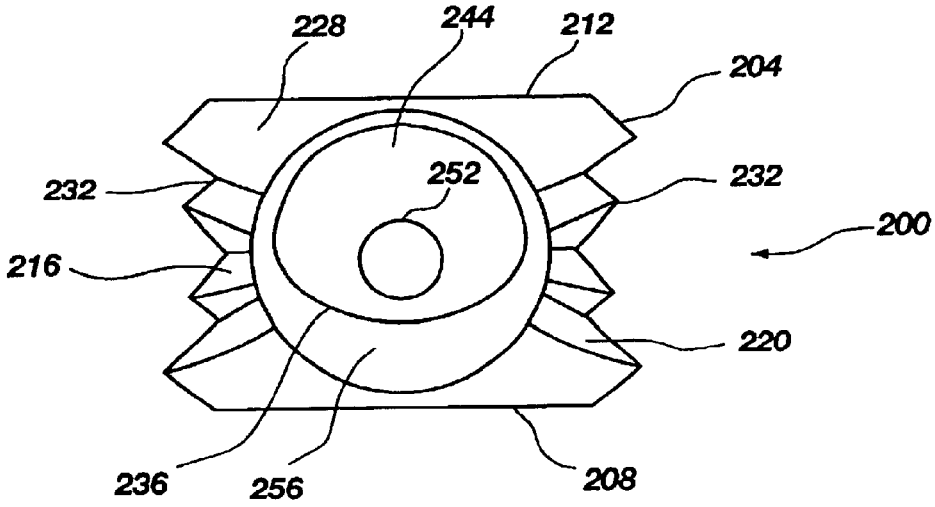

FIG. 19 shows a top view of the food delivery apparatus of FIG. 17.

Figure 20:
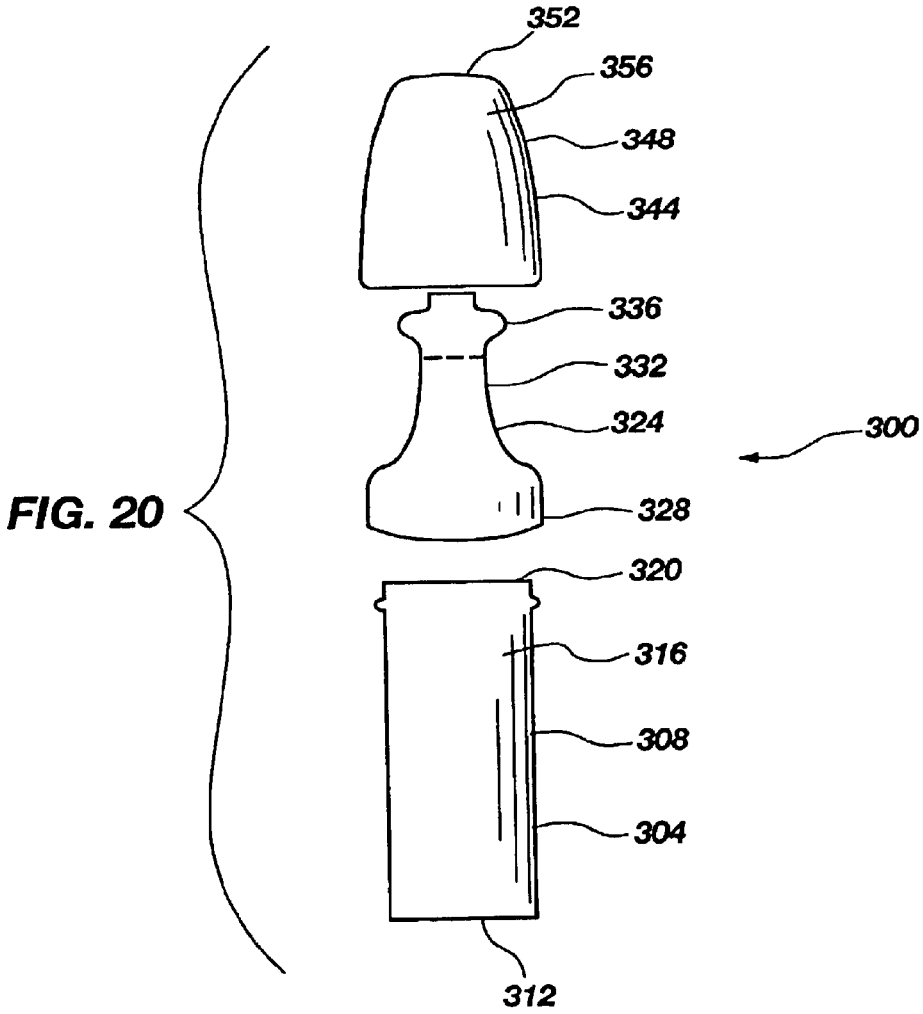

FIG. 20 shows an exploded front elevation view of an illustrative embodiment of a food delivery apparatus according to the present invention.

FIGS. 20A-C show perspective views of an illustrative embodiment of a food delivery apparatus according to the present invention.

Figure 21:
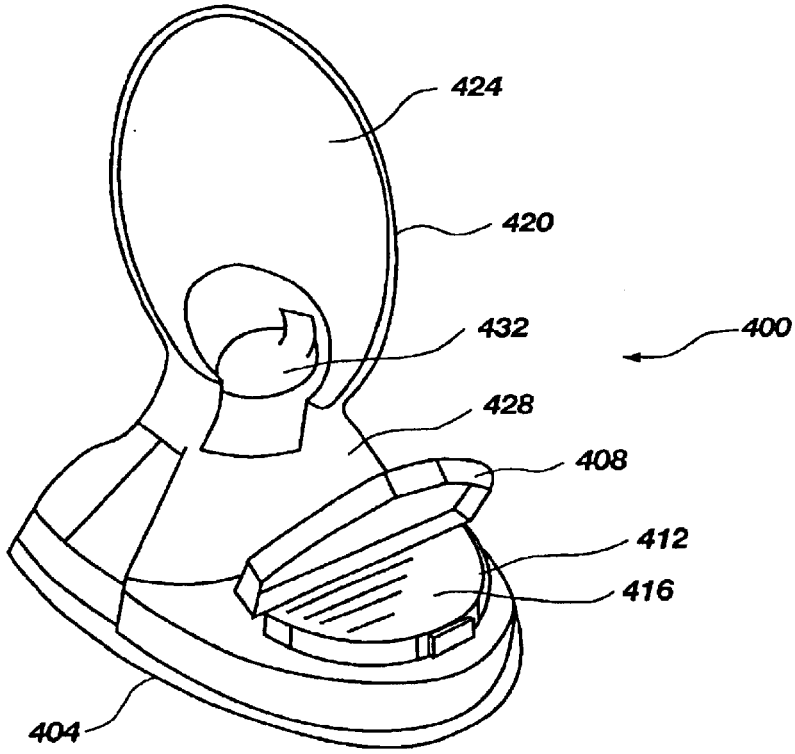

FIG. 21 shows a perspective cutaway view of an illustrative embodiment of a food delivery apparatus according to the present invention.

Figure 22:
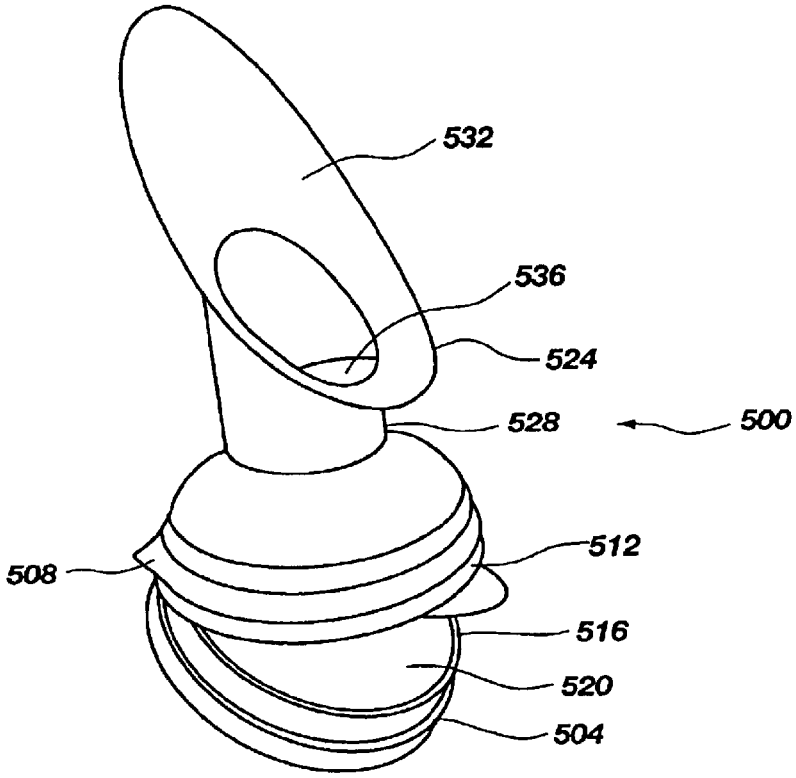

FIG. 22 shows a perspective view of an illustrative embodiment of a food delivery apparatus according to the present invention.

DETAILED DESCRIPTION

Before the present disposable food delivery apparatus and methods of making and using thereof are disclosed and described, it is to be understood that this invention is not limited to the particular configurations, process steps, and materials disclosed herein as such configurations, process steps, and materials may vary somewhat. It is also to be understood that the terminology employed herein is used for the purpose of describing particular embodiments only and is not intended to be limiting since the scope of the present invention will be limited only by the appended claims and equivalents thereof.

The publications and other reference materials referred to herein to describe the background of the invention and to provide additional detail regarding its practice are hereby incorporated by reference. The references discussed herein are provided solely for their disclosure prior to the filing date of the present application. Nothing herein is to be construed as an admission that the inventors are not entitled to antedate such disclosure by virtue of prior invention.

It must be noted that, as used in this specification and the appended claims, the singular forms "a," "an," and "the" include plural referents unless the context clearly dictates otherwise. Thus, for example, reference to disposable food delivery apparatus containing "a port" includes reference to an apparatus containing two or more of such ports, reference to "a utensil" includes reference to one or more of such utensils, and reference to "a valve" includes reference to two or more of such valves.

It is certified that error appears in the above-identified patent and that said Letters Patent is hereby corrected as shown below:

Column 1, line 2, through Column 6, line 67 (cont'd),

In describing and claiming the present invention, the following terminology will be used in accordance with the definitions set out below.

As used herein, "comprising," "including," "containing," "characterized by, and grammatical equivalents thereof are inclusive or open-ended terms that do not exclude additional, unrecited elements or method steps. "Comprising" is to be interpreted as including the more restrictive terms "consisting of" and "consisting essentially of.".

As used herein, "consisting of" and grammatical equivalents thereof exclude any element, step, or ingredient not specified in the claim.

As used herein, "consisting essentially of" and grammatical equivalents thereof limit the scope of a claim to the specified materials or steps and those that do not materially affect the basic and novel characteristic or characteristics of the claimed invention.

FIGS. 1-6 show an illustrative food delivery apparatus according to the present invention. The food delivery apparatus 10 comprises a food container 12, a food utensil 14, and a cap 16. The food container comprises a flexible bag 18 and a collar 20. The flexible bag 18 is disposed on the collar 20 such that there is no leakage of liquid or semi-liquid food therebetween. The flexible bag 18 can be attached to the collar 20 by heat sealing, use of an appropriate adhesive, or the like, according to methods well known in the art. In an illustrative embodiment of the invention, the flexible bag is made of a flexible plastic material, such as polyethylene, polypropylene, or other suitable polymers. The flexible bag is sealed at the bottom 22 thereof, such as by heat sealing, thereby forming a vessel 24 for holding food.

The collar 20 comprises a lower portion 26 (shown in phantom in FIG. 1) to which the flexible bag 18 is attached, a middle portion 28 coupled to the lower portion 26, and a neck 30 coupled to the middle portion 28. The neck 30 comprises a plurality of ridges 32 for use in releasably attaching the food container 12 to the food utensil 14. This releasable attachment will be described in more detail below.

In an illustrative embodiment of the invention, the collar further comprises an opening 34 through which the food in the food container 12 can pass from the food container 12 to the food utensil 14. In an illustrative embodiment of the invention, this opening 34 is sealed with a seal 36 after placing a food, such as a dehydrated food, in the food container 12 at the factory. This seal prevents the entry of moisture or contaminants from contacting the food until the seal is removed by the consumer just prior to use.

In an illustrative embodiment of the food delivery apparatus 10, the food utensil 14 comprises a bowl 38 disposed on a funnel member 40, which is in turn disposed on a ring member 42. The lower edge of the funnel member 40 comprises a rim 44. This rim 44 is configured for cooperatively engaging the inner surface of the cap 16 for holding the cap 16 in place over the bowl 38 and funnel member 40, as will be described in more detail below. The funnel member 40 comprises a channel 46 for receiving food from the food container 12 and channeling it to the bowl 38. The channel 46 ends It is certified that error appears in the above-identified patent and that said Letters Patent is hereby corrected as shown below:

Column 1, line 2, through Column 6, line 67 (cont'd), at an opening 48 in the bowl 38. Thus, food that is channeled through the channel 46 enters the bowl 38 through the opening 48. Once the food is in the bowl 38, it is ready to be eaten by the consumer.

As shown in FIG. 4, the ring member 42 of the food utensil 14 comprises an inner wall 47 on which are disposed a plurality of ridges 49. These ridges 49 are configured to cooperatively engage the ridges 32 of the collar 20 such that the food utensil 14 can be attached to the collar 20 by twisting and tightening the food utensil 14 onto the collar 20, resulting in a leak-proof seal of the top edge 35 of the neck 30 against the inside rim 45 of the food utensil 14. Friction of the ridges 32 of the neck 30 against the inner ridges 49 of the food utensil 14 holds the top edge 35 against the inside rim 45.

The cap 16 comprises a housing 50 that defines a chamber 52. The housing 50 comprises a side wall 54 and a top 56 disposed thereon. Extending downward from the top 56 is a plug 58, which is configured for fitting into the channel 46 of the utensil when the cap 16 is in place over the bowl 38 and funnel member 40. The plug 58 closes the channel 46 for preventing food from passing therethrough. The lower end of the inner wall 60 of the cap 16 is configured for cooperatively engaging the rim 44 of the food utensil 14 such that the cap 16 is held in place by friction of the inner wall 60 against the rim 44.

As mentioned above, in an illustrative embodiment of the invention, food, such as instant mashed potatoes, is placed in the food container 12 in the factory, and a seal 36 is placed over the opening 34 of the neck 30 to seal the food inside the food container 12 to prevent contamination of the food with water or other contaminants. The food utensil 14 is twisted onto the neck 30 of the food container 12, and the cap 16 is placed on the food utensil 14 such that the plug 58 closes the channel 46 and the cap is held in place by the friction of the inner wall 60 against the rim 44. The consumer uses the food delivery apparatus 10 by untwisting the food utensil 14 from the food container 12, removing the seal 36, adding hot water to the food contained in the food container (if such food is dehydrated food), and replacing the food utensil 14. The food is rehydrated and mixed, if necessary, by manipulating the flexible bag 18 until mixing is complete. It will be appreciated that the plug 58 extending into the channel 46 prevents the food from passing through the channel 46 until the cap is removed. Next, the cap is removed and the flexible bag is squeezed, thus allowing the flowable food to pass out of the food container through the opening 34, through the funnel member 40, through the channel 46, and into the bowl 38 of the food utensil 14. Once the food is present in the bowl 38, the food utensil 14 functions as a spoon, and the consumer can eat the food. After the food is consumed, the food delivery apparatus 10 can be disposed of.

In an alternative embodiment of the food delivery apparatus of FIGS. 1-6, the bowl 38 can be replaced with a tubular, straw-like member. In this embodiment, the food passes through the channel and the tubular, straw-like member. The consumer can place the tubular, straw-like member in her mouth and receive the flowable food directly It is certified that error appears in the above-identified patent and that said Letters Patent is hereby corrected as shown below:

Column 1, line 2, through Column 6, line 67 (cont'd),
therefrom.

FIGS. 7-16 show another illustrative embodiment of a food delivery apparatus 100 according to the present invention. The food delivery apparatus 100 comprises a food container 104 for holding a flowable food. The food container comprises a side wall 105, which defines a chamber 106. A funnel member 108 is disposed on the upper end of the food container 104, comprising a neck 110. Disposed on the neck 110 is a food utensil 112. A channel 116 passes through the neck 110 to an opening 120.

The food delivery apparatus 100 further comprises a plunger 124 configured for fitting into the chamber 106. The plunger 124 comprises a plug 128 configured for fitting into the funnel member 108. The upper end 132 of the plug 128 is configured for being received into the channel 116, thereby plugging the channel 116 and preventing the passage of food therethrough. The plunger also comprises a side wall 136 having an upper edge 140 configured for contacting the inner wall 144 of the food container 104. The plunger 124 is configured to slide in the chamber 106 for pushing food contained in the chamber 106 through the funnel member 108, into the channel 116, and out through the opening 120 into the bowl 148 of the food utensil 112. The upper edge 140 illustratively slides with little play next to the inner wall 144 such that virtually all of the food is scraped from the inner wall 144 and pushed into the funnel member 108. A pressure plate 152 is conveniently disposed on the bottom edge 156 of the plunger 124. Pressure applied to the pressure plate 152 causes the plunger 124 to slide in the chamber 106, thereby pushing the food as described above.

Illustratively, the food delivery apparatus 100 further comprises a cap 160 comprising a wall 164 defining a cavity 168. The cap 160 is configured for fitting over the funnel member 108 and food utensil 112 for protecting them from contamination. An Inner wall 172 of the cap 160 is configured for cooperatively associating with a rim 176 at an upper end of the side wall 105 of the food container 104. Friction of the rim 176 against the inner wall 172 causes the cap 160 to remain in place disposed over the funnel member 108 and the food utensil 112.

The food delivery apparatus 100 is used by placing a flowable food, such as mashed potatoes or pureed food, such as a baby food, in the chamber 106, placing the plunger 124 in the chamber 106 with the plug 128 toward the funnel member 108, placing the pressure plate 152 at the bottom edge 156 of the plunger 124, removing the cap 160, and them applying pressure to the pressure plate 152, thereby causing the plunger 124 to slide in the chamber 106 such that the food is pushed toward the funnel member 108. As the plunger 124 slides against the inner wall 144 of the food container 104, the upper edge 140 of the side wall 136 of the plunger scrapes any food adhering to the inner wall 144 and pushes it toward the funnel member 108, as well. Continued application of pressure pushes the food into the channel 116, and eventually the food exits the channel 116 at the opening 120 such that the food is delivered to the bowl 148 of the food utensil 112. The food is then available to be consumed.

It is certified that error appears in the above-identified patent and that said Letters Patent is hereby corrected as shown below:

Column 1, line 2, through Column 6, line 67 (cont'd),

FIGS. 17-19 show another illustrative food delivery apparatus according to the present invention. The food delivery apparatus 200 comprises a food container 204 comprising a front wall 208, a back wall 212, two side walls 216 and 220, and a bottom 224, which define a chamber 228 for holding the food. The side walls 216 and 220 and the bottom 224 are pleated in this illustrative embodiment. Further, the food container 204 is made of a flexible material, such as a flexible plastic, so that applying pressure to the front wall 208 and the back wall 212 causes the side walls 216 and 220 and the bottom 224 to bend at the pleats 232. This bending of the side walls 216 and 220 and the bottom 224 at the pleats results in a reduction of the volume contained in the chamber 228 and squeezing of the food out of the chamber 228.

Disposed on the food container 204 is a food utensil 236 comprising a neck 240 and a bowl 244. The neck 240 is hollow, thus defining a conduit 248, which is in open communication with the chamber 228 such that food squeezed out of the food container 204 enters the conduit 248. It will be appreciated that additional squeezing of food out of the chamber 228 causes additional food to move out of the chamber 228 into the conduit 248 and to push food through the conduit 248. The conduit 248 ends at an opening 252 in the bowl 244. Food that is pushed through the conduit 248 enters the bowl 244 through this opening 252. The illustrative embodiment of the invention shown in FIGS. 17-19 also contains a ring 256 disposed around the neck 240. This ring 256 prevents the bowl 244 from coming into contact with a table or other surface when the food delivery apparatus 200 is placed on such a table or other surface. Thus, the ring 256 assists in keeping the bowl 244 clean from contamination. The ring 256 also prevents a child from placing the bowl 244 too far into the mouth, and thus has a safety function. Further, the ring 256 prevents food from spilling from the opening 252 onto the front wall 208, back wall 212, or side walls 216 and 220.

The food container 204 and food utensil 236 can be molded as an integral unit such that the food container 204 and the food utensil 236 are made of the same material.

The food delivery apparatus 200 further comprises a cap 260 (FIGS. 17-18) configured for being placed over the bowl 244 and neck 240 for keeping these parts clean when not in use. The cap 260 comprises a side wall 264 and a top 268, which define a cavity 272 configured for receiving the bowl 244 and neck 240. The cap 260 can be made of a rigid material, such as a rigid plastic, such as polycarbonate.

FIG. 20 shows another illustrative embodiment of a food delivery apparatus according to the present invention. This embodiment of the food delivery apparatus 300, which can be conceptualized as an "adult straw" embodiment-analogous to a drinking straw, comprises a food container 304 comprising a side wall 308 and a bottom 312, which define a chamber 316 for holding the food. The food container 304 includes an opening 320 through which the food can be transferred out of the food container 304.

It is certified that error appears in the above-identified patent and that said Letters Patent is hereby corrected as shown below:

Column 1, line 2, through Column 6, line 67 (cont'd),

Disposed on the food container 304 is a hollow food utensil 324 comprising a lower portion 328, a neck 332, and a lid 336. The lower portion 328 is configured to fit cooperatively over the opening 320 of the food container 304 to form a leak-proof seal. This leak-proof seal can be formed by any method known in the art, such as by heat sealing, by a twist seal, by an appropriate adhesive, and the like. The neck 332 and the lid 336 are separated from each other by a thin-walled section of the wall or break point 340.

The cap 344 comprises a wall 348, and a top 352 defining a chamber 356 configured for receiving the lid 336 and neck 332 of the food utensil 324.

Illustratively, the food is placed in the food container 304, and the food utensil 324 and cap 344 are put in place in the factory. The consumer uses the food delivery apparatus 300 by removing the cap 344, removing the lid 336 at the break point 340, adding water if needed, replacing the lid 336 and cap 344, mixing the contents of the food container 304, then removing the cap 344 and lid 336, and dispensing the food through the neck 332 for consumption.

FIGS. 20A-C show an illustrative embodiment of a "child straw" variation of the present Invention. This embodiment comprises a food container 364, similar to the food container 204 of FIGS. 17-19. At the top of the food container is a neck 368, which includes a "break point" 370 that comprises a thin-walled portion of the neck. Referring now to FIG. 20A, as initially fabricated, at the top of the neck 368 is a receptacle 372, through which the food is inserted into the food container 364 at the factory. After the food is inserted into the food container, the receptacle 372 is heat sealed to prevent the food from leaking from the food delivery apparatus and to prevent adulteration of the food. FIG. 20B shows the heat-sealed receptacle 376. Once the consumer is ready to use the product, the heat-sealed receptacle 376 is twisted or otherwise manipulated with respect to the food container 364 such that the neck 368 breaks at the break point 370, thus creating an opening 380 (FIG. 20C) through which the food can be squeezed out for consumption. Optionally, this embodiment of the invention can include a cap 384 that locks onto the neck 368, covering the heat-sealed receptacle 376, for providing an extra layer of safety for consumers and providing a more aesthetically pleasing appearance. FIG. 21 shows another illustrative embodiment of a food delivery apparatus 400 according to the present invention. This embodiment comprises a base 404, which is attachable to a food container (not shown). The base comprises a fill door 408 configured for covering a fill port 412. In this embodiment, the fill port 412 is covered with a removable security seal 416. Disposed on the base 404 is a food utensil 420 comprising a bowl 424 and a neck 428. The neck is hollow such that food can flow from the food container to the neck 424, and from the neck 424 to the bowl 428. Across the opening of the neck 428 is another security seal 432.

This embodiment of the invention is used by opening the fill door 408, removing the security seal 416, and pouring water through the fill port 412. The fill door 408 is then

UNITED STATES PATENT AND TRADEMARK OFFICE

CERTIFICATE OF CORRECTION

PATENT NO. : 6,802,423 B2
DATED : October 12, 2004
INVENTOR(S) : John J. O'Brien It is certified that error appears in the above-identified patent and that said Letters Patent is hereby corrected as shown below:

Column 1, line 2, through Column 6, line 67 (cont'd), closed, and water is mixed with the food in the food container. Next, the security seal 432 across the neck 428 of the food utensil 420 is removed, and food is squeezed out of the food container, through the neck 428, and into the bowl 424, where the food may be eaten by the consumer.

FIG. 22 shows another illustrative embodiment of the invention. This food delivery apparatus 500 comprises a cap base 504 connected by a hinge 508 to a cap top 512. The cap base comprises an opening 516, which is covered by a security seal 520. Disposed on the cap top 512 is a food utensil 524 comprising a hollow neck 528 on which is disposed a bowl 532. An anti-spill valve 536 is configured across the hollow neck to prevent spills of food.

This food delivery apparatus 500 is used by attaching the cap base 504 to a food container (not shown), which is filled with food at the factory. The consumer lifts the cap top 512 to reveal the security seal 520. The security seal 520 is removed, thus clearing the opening 516. Water can be poured through the opening 516, and then the cap top 512 is closed and the water is mixed with the food in the food container. The food is then squeezed out of the food container, through the cap base 504, through the cap top 512, through the neck 528, and into the bowl 532 where it available to be consumed.

The food delivery apparatus of the present invention can be made by injection molding, blow molding, and other techniques known in the art of molding plastic parts. --.

Signed and Sealed this

Twenty-fifth Day of October, 2005

JON W. DUDAS
*Director of the United States Patent and Trademark Office*